United States Patent [19]

Andreassen et al.

[11] 4,308,116

[45] Dec. 29, 1981

[54] METHOD AND ELECTROLYZER FOR PRODUCTION OF MAGNESIUM

[75] Inventors: Knut A. Andreassen, Porsgrunn; Øystein Bøyum, Skien; Henry K. Johnsen, Porsgrunn; Leiv B. Ognedal, Porsgrunn; Peder R. Solheim, Porsgrunn, all of Norway

[73] Assignee: Norsk Hydro a.s., Oslo, Norway

[21] Appl. No.: 159,927

[22] Filed: Jun. 16, 1980

[30] Foreign Application Priority Data

Jun. 26, 1979 [NO] Norway ..... 792133

[51] Int. Cl.[3] ..... C25C 3/04

[52] U.S. Cl. ..... 204/70; 204/244; 204/245; 204/247

[58] Field of Search ..... 204/70, 244, 245, 247

[56] References Cited

U.S. PATENT DOCUMENTS

| | | | |
|---|---|---|---|
| 1,567,318 | 12/1925 | Cottringer et al. | 204/70 |
| 1,861,798 | 6/1932 | Hunter et al. | 204/70 |
| 2,375,009 | 5/1945 | Lepsol et al. | 204/70 |
| 2,393,686 | 1/1946 | Hunt et al. | 204/70 |
| 2,396,171 | 3/1946 | Gardiner | 204/70 |

FOREIGN PATENT DOCUMENTS 1149538 1/1964 Fed. Rep. of Germany .

*Primary Examiner*—Howard S. Williams

*Attorney, Agent, or Firm*—Wenderoth, Lind & Ponack

[57] ABSTRACT

Magnesium is electrolytically produced from a salt melt comprising magnesium chloride by the use of an electrolyzer having at least one electrolysis compartment and at least one metal separating compartment separated from the electrolysis compartment by a partition wall. Magnesium chloride is fed in solid form in a direction counter current to the flow of chlorine gas liberated during electrolysis to a melting room or chamber in the electrolysis compartment arranged such that contact between the magnesium chloride and the anodes of the electrolyzer is avoided. Flow patterns are produced in the melt to ensure that sludge forming impurities in the fed magnesium chloride are continuously removed from the electrolysis compartment to the metal separating compartment.

7 Claims, 2 Drawing Figures

METHOD AND ELECTROLYZER FOR PRODUCTION OF MAGNESIUM

BACKGROUND OF THE INVENTION

The present invention relates to a method and an electrolyzer for the production of magnesium and chlorine from salt melt comprising magnesium chloride using magnesium chloride in a solid state.

Feeding of magnesium chloride in solid state to magnesium electrolysis cells is known from earlier patent literature, e.g. U.S. Pat. Nos. 1,567,318, 1,861,798 and 2,396,171. In all these cases a water containing magnesium chloride is used in different hydrated states of $MgCl_2$ containing from 2 to 5 molecules of $H_2O$. It is known that the water in the electrolysis cells reduces the current and power efficiency. It is further known that these water containing salts, e.g. $MgCl_2.6H_2O$ during normal dehydration decompose upon formation of MgO, HCl, and $H_2O.MgO$ as an inert constituent settles to the bottom of the electrolysis compartment where, together with a part of the melt, it forms a sludge which accumulates and interferes with cell operation and accordingly has to be regularly removed. HCl, $H_2O$-vapor and air accompanying the $MgCl_2$-granules attack the graphite anodes and cause considerable dillution of the chlorine gas.

In order to suppress this decomposition reaction it has been suggested in the above mentioned patents to introduce the $MgCl_2$-granules at a point close to the anodes, which means in the atmosphere of concentrated $Cl_2$ liberated at the anodes. This solution had some positive influence on the cell operation, but did not solve the problem regarding anode wear and dilution of the $Cl_2$-gas.

German Pat. No. 1.149.538 describes an electrolysis cell with a preheated feeding chamber where magnesium chloride is melted and treated by a gas which suppresses the hydrolysis prior to the transfer of the melt to the electrolysis compartment. This solution gives a rather complicated cell construction and results in a higher energy consumption because of the preheating of the feeding chamber and additional expenses relating to the treatment gas.

SUMMARY OF THE INVENTION

It is therefore an object of the present invention to provide a method for the production of magnesium and chlorine without the above mentioned draw-backs, where $MgCl_2$ in solid state is brought directly into the electrolysis compartment in such a manner that contact between $MgCl_2$-prills and the graphite anodes with the resultant anode-wear is avoided.

It is a further object of the invention to ensure that the sludge forming impurities fed to the electrolysis cell together with the $MgCl_2$-prills are continuously removed from the electrolysis compartment to an adjacent metal separating compartment.

Still another object of the method according to the present invention is to obtain a combined effect from the gas cooling which results in a lower loss of chlorides from the melt, because of the condensation of sublimates from melt on the prills, and preheating of prills so that local cooling of the melt is reduced.

These objects are achieved by feeding magnesium chloride in solid state in a counter current flow with the liberated chlorine gas to the electrolysis compartment at a certain distance from the anodes in an area which is specially arranged in order to avoid contact between the magnesium chloride and the anodes, and where the flow patterns in the melt ensures that sludge forming impurities in the added magnesium chloride are continuously carried out from the electrolysis compartment to the adjacent metal separating compartment.

The invention further concerns an electrolyzer to carry out the present method. The electrolyzer comprises an electrolysis compartment and a metal separating compartment separated from each other by means of a partition wall and equipped with alternately arranged anodes and cathodes.

The electrolyzer is especially characterized in that a shielded area is arranged in the electrolysis compartment where magnesium chloride is fed, and this area is formed as a melting room between two anodes where the distance between them is larger than the distance between the other adjacent anodes in the electrolysis compartment.

In this melting room magnesium chloride is fed close to a partition wall between the electrolysis compartment and the metal separating compartment, through a central chlorine exhaust bell in counter current flow with the chlorine gas liberated during electrolysis. A natural circulation which occurs in the melt mainly due to the so called "gas-lift" effect at the anodes, keeps the prills which comprise some air away from the anodes and at the same time provides the speedy transport of the melt from the melting room to the metal separating compartment. A cross-wall arranged across the electrolysis compartment, with a suitable formed front part close to the partition wall extending beneath the melt level and forming a bottom part of the melting room, contributes further to obtaining favourable flow patterns in the melt.

Other advantages and objects of the invention will be apparent from the following description.

The method according to the invention provides the possibility of feeding magnesium chloride directly to the electrolysis compartment without causing wear of the graphite anodes by air which is sucked in together with the $MgCl_2$-prills.

The speedy transport of melted prills from the electrolysis compartment to the metal separating compartment prevents the sludge-forming impurities from accumulating in the electrolysis compartment, from interfering with cell operation and thereby from resulting in lower current efficiency. Use of the substantially anhydrous $MgCl_2$-prills ($H_2O<0.2\%$) with a low content of MgO ($<0.15\%$) results in a considerable reduction of the total quantity of sludge. The continuous feeding of prills gives a possibility of process automation, secures a better control of melt composition and gives less fluctuation of the melt level.

Feeding the prills in a counter current flow with respect to the chlorine gas liberated during the electrolysis gives a combined effect of gas cooling and prills preheating. Reduced loss of chlorides from the melt has been recorded as a result of the condensation of sublimates on the prills. The local down-cooling of the melt in the feeding area is considerably reduced.

The central chlorine exhaust bell is dimensioned in such a way that the loss of feed as dust from the prills is minimized.

BRIEF DESCRIPTION OF THE DRAWINGS

The invention will be described more fully in the following more detailed description of an electrolyzer which is particularly suitable for $MgCl_2$-feeding according to the invention and which is shown in the accompanying drawings, wherein.

DETAILED DESCRIPTION OF THE INVENTION

Figure 1:
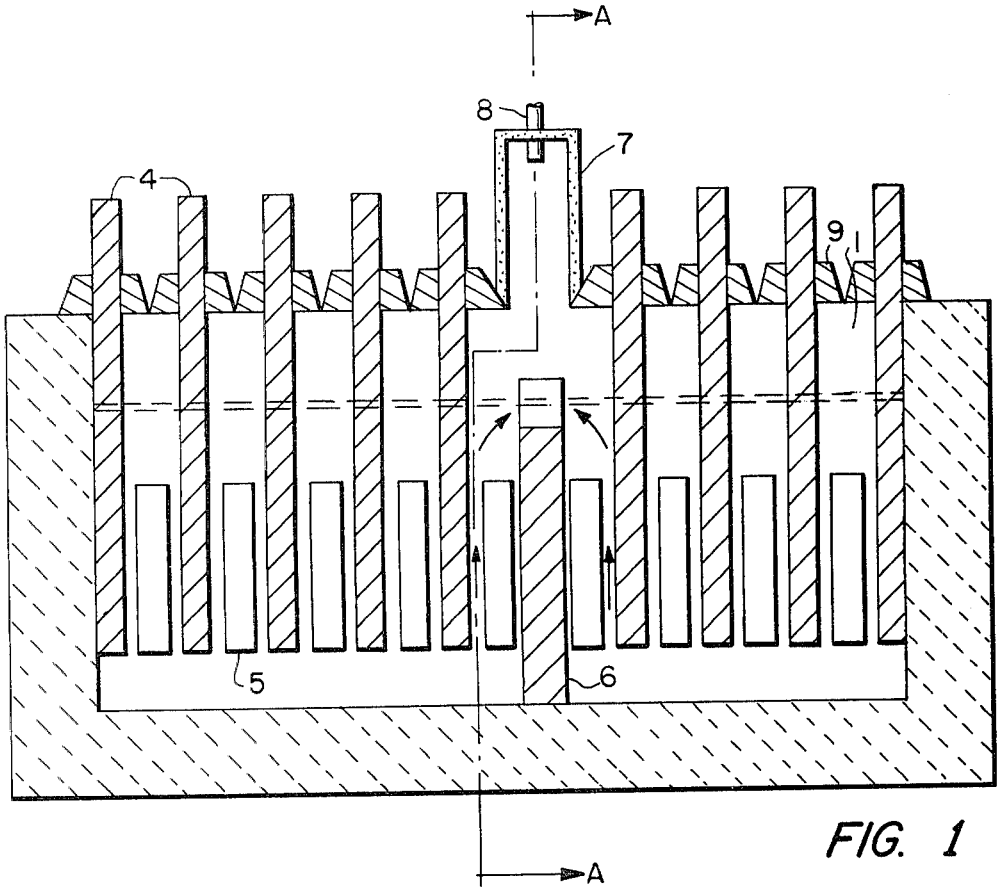
FIG. 1 is a schematic view taken in vertical cross section longitudinally of an electrolysis compartment according to the invention.

FIG. 1 shows a schematic view of an electrolysis compartment (1) with alternately arranged anodes (4) and cathodes (5). In a wider gap between the anodes, which in this case is formed by removing one of the anodes, there is arranged a cross-wall (6) extending transversly in the electrolysis compartment. A chlorine gas exhaust bell (7) with a feeding pipe (8) for supplying $MgCl_2$-prills and connected to a conventional feeding apparatus and silo (not shown the figure), is arranged above the cross-wall and fastened to a cover plate (9) of the electrolysis compartment. Design of the cross-wall, which is partly submerged in the melt and which partly protrudes above the melt level, can best be seen in FIG. 2.

Figure 2:
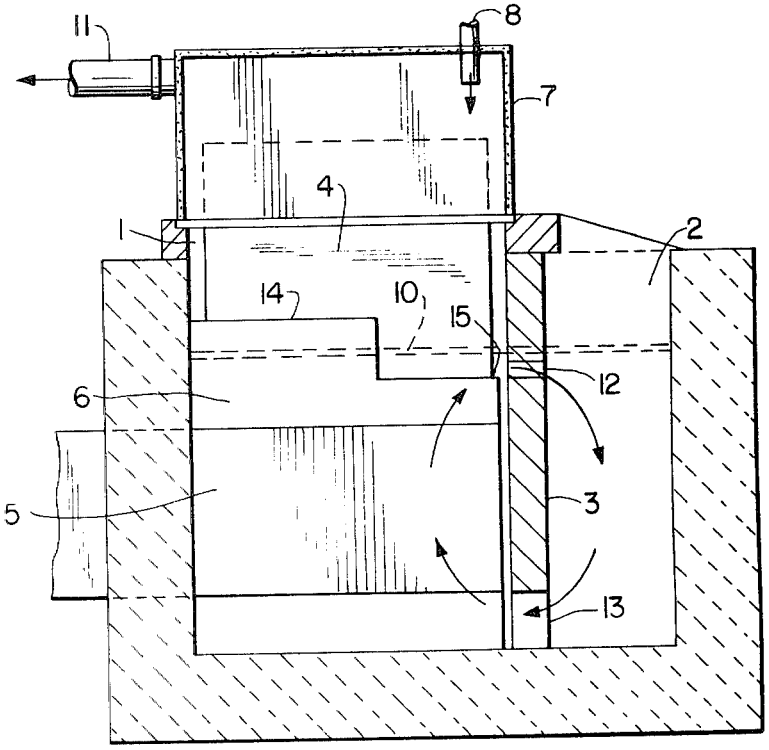
FIG. 2 is a vertical cross section taken along line A—A in FIG. 1.

FIG. 2, which is a vertical cross section of the electrolyzer, shows that the electrolysis compartment (1) and metal separating compartment (2) are separated from each other by means of a partition wall (3).

The partition wall has apertures (13) at its lower end for transfer of the melt to the electrolysis compartment. There are further arranged apertures (12) at its upper end below the melt level so that the melt together with the separated magnesium metal flow through the apertures to the metal separating compartment.

During electrolysis of chloride melt, there occurs a natural circulation of the melt because of a gas-lift effect in the interpolar spaces between electrodes, such as indicated by arrows on the figures.

In the wide gap above the cross-wall (6) there it is formed a shielded melting room (10), where $MgCl_2$-prills which fall down to the melt through the gas exhaust bell are melted, and simultaneously the natural flow pattern in the melt protects the anodes on both sides of the melting room against the prills and any accompanying air.

This melting room (10) is further limited by a stair-step-like configuration of cross-wall (6) which is provided with a rear part (14) protruding above the melt level, and a front part (15) at the partition wall (3) which is beneath the melt level and forms the bottom part of the melting room.

The central chlorine gas exhaust bell (7) is, by means of a pipe (11), conducted to a gas exhaust system (not shown in the figure).

FIG. 2 also shows one of the graphite anodes (4) behind the cross-wall and one cathode (5) in front of the cross-wall.

The electrolyzer which is shown in FIGS. 1 and 2 represents only one particular embodiment of an electrolyzer which may be used to practice the method according to the invention.

Other constructions and modifications can be applied in order to achieve favourable flow conditions in the melt. Different shapes of the cross-wall and its location with regard to the partition wall give possibilities for an extensive regulation of the flow patterns in the melting room.

The electrolyzer may have a plurality of electrolysis compartments and metal separating compartments, and furthermore the chlorine exhaust bell shown in the figures may have different shapes and locations on the electrolyzer.

We claim:

1. A method for the electrolytic production of magnesium from a salt melt comprising magnesium chloride by the use of an electrolyzer having at least one electrolysis compartment and at least one metal separating compartment separated from said electrolysis compartment by a partition wall, said method comprising:

feeding magnesium chloride in solid form, and in a direction counter current to the flow of chlorine gas liberated during electrolysis occuring in said electrolyzer, to an area in said electrolysis compartment arranged such that contact between said magnesium chloride and the anodes of said electrolyzer is avoided, and providing flow patterns of said melt to ensure that sludge forming impurities in said fed magnesium chloride are continuously removed from said electrolysis compartment to said metal separating compartment.

2. A method as claimed in claim 1, comprising feeding said solid form magnesium chloride to a melting room formed between two adjacent said anodes spaced further from each other than other adjacent said anodes in said electrolysis compartment and limited by a cross wall arranged transversely in said electrolysis compartment.

3. A method as claimed in claim 2, comprising providing a central chlorine exhaust bell covering said melting room, and feeding said magnesium chloride in the form of substantially anhydrous prills through said central chlorine exhaust bell into said melting room at a position closely adjacent to said partition wall.

4. An electrolyzer for the electrolytic production of magnesium from a salt melt, said electrolyzer comprising:

at least one electrolysis compartment and at least one metal separating compartment separated from said electrolysis compartment by a partition wall, said electrolysis compartment having therein alternately arranged cathodes and anodes; and said electrolysis compartment having therein an area to which is fed magnesium chloride in solid form, said area comprising a shielded melting room defined between two adjacent said anodes which are further sp ced from each other than other adjacent said anodes.

5. A electrolyzer as claimed in claim 4, further comprising a cross wall extending transversely through said electrolysis compartment at a position between said two adjacent anodes, said cross wall having a rear part spaced from said partition wall and protruding above the level of the salt melt, and a front part adjacent said partition wall and beneath the level of the salt melt, said front part of said cross wall defining the bottom of said melting room.

6. An electrolyzer as claimed in claim 5, wherein a said cathode is arranged on each of opposite sides of said cross wall.

7. An electrolyzer as claimed in claims 4 or 5, further comprising a central chlorine exhaust bell arranged on the electrolyzer above said melting room, said bell including a pipe for the supply therethrough of solid form magnesium chloride.

* * * * *

UNITED STATES PATENT AND TRADEMARK OFFICE

CERTIFICATE OF CORRECTION

PATENT NO. : 4,308,116

DATED : December 29, 1981

INVENTOR(S) : KNUT A. ANDREASSEN ET AL.

It is certified that error appears in the above—identified patent and that said Letters Patent is hereby corrected as shown below:

On the cover page, under the listed inventors, following "Peder R. Solheim, Porsgrunn," insert --Oddmund Wallevik, Porsgrunn,--.

Signed and Sealed this

*Tenth* Day of *August 1982*

[SEAL]

*Attest:*

GERALD J. MOSSINGHOFF

*Attesting Officer*

*Commissioner of Patents and Trademarks*